US011867162B2

(12) United States Patent
Junod et al.

(10) Patent No.: US 11,867,162 B2
(45) Date of Patent: Jan. 9, 2024

(54) PRECISION, CONSTANT-FLOW RECIPROCATING PUMP

(71) Applicant: SWISSINNOV PRODUCT SARL, Gland (CH)

(72) Inventors: Florent Junod, Corsier (CH); Thierry Navarro, Gland (CH)

(73) Assignee: SWISSINNOV PRODUCT SARL, Gland (CH)

( * ) Notice: Subject to any disclaimer, the term of this patent is extended or adjusted under 35 U.S.C. 154(b) by 0 days.

(21) Appl. No.: 17/285,157

(22) PCT Filed: Oct. 10, 2019

(86) PCT No.: PCT/EP2019/077495
§ 371 (c)(1),
(2) Date: Apr. 14, 2021

(87) PCT Pub. No.: WO2020/078825
PCT Pub. Date: Apr. 23, 2020

(65) Prior Publication Data

US 2021/0293226 A1 Sep. 23, 2021

(30) Foreign Application Priority Data

Oct. 14, 2018 (WO) ..... PCT/IB2018/057954
May 12, 2019 (WO) ..... PCT/EP2019/062117

(51) Int. Cl.
*F04B 1/02* (2006.01)
*F04B 7/00* (2006.01)
(Continued)

(52) U.S. Cl.
CPC ..... *F04B 1/02* (2013.01); *F04B 1/03* (2020.01); *F04B 7/003* (2013.01); *F04B 7/0053* (2013.01);
(Continued)

(58) Field of Classification Search
CPC .... F04B 1/02; F04B 1/03; F04B 7/003; F04B 7/0053; F04B 7/0069; F04B 9/04;
(Continued)

(56) References Cited

U.S. PATENT DOCUMENTS 5,655,891 A 8/1997 Deal et al.
7,278,836 B2 10/2007 Hammonds
(Continued)

FOREIGN PATENT DOCUMENTS

FR 572925 A 6/1924
WO 2014060965 A2 4/2014

OTHER PUBLICATIONS

International Search Report for PCT/EP2019/077495 prepared by the European Patent Office, dated Mar. 6, 2020.

*Primary Examiner* — Devon C Kramer
*Assistant Examiner* — Joseph S. Herrmann
(74) *Attorney, Agent, or Firm* — Brooks Kushman P. C.; John E. Nemazi

(57) ABSTRACT

A pump having two pistons which are driven by a cam belonging to an external rotor and which are inserted into two cylinder blocks mounted parallel to each other in such a way as to form two opposite, parallel, eccentric pump chambers The pump chambers have at least one inlet port through which liquid is drawn into the pump chambers during the fill stroke of the pistons, and then expelled from the pump chambers during the discharge stroke of the pistons to at least one outlet port, the outflow rate of which is constant and even.

14 Claims, 16 Drawing Sheets

(51) Int. Cl.

| | |
|---|---|
| ***F04B 1/03*** | (2020.01) |
| ***F04B 9/04*** | (2006.01) |
| ***F04B 23/06*** | (2006.01) |
| *F04B 41/06* | (2006.01) |

(52) U.S. Cl.
CPC ..... *F04B 7/0069* (2013.01); *F04B 9/04* (2013.01); *F04B 9/047* (2013.01); *F04B 23/06* (2013.01); *F04B 41/06* (2013.01)

(58) Field of Classification Search
CPC ..... F04B 9/042; F04B 9/047; F04B 7/0019; F04B 7/0057; F04B 7/0061; F04B 7/0065; F04B 9/0045; F04B 23/06; F04B 41/06; F04B 27/005
See application file for complete search history.

(56) References Cited

U.S. PATENT DOCUMENTS

| | | | | |
|---|---|---|---|---|
| 9,022,755 | B2 * | 5/2015 | Junod | F04B 7/0046 417/516 |
| 2015/0147210 | A1 * | 5/2015 | Navarro | F04B 9/047 417/539 |
| 2017/0234307 | A1 * | 8/2017 | Junod | F04B 7/0007 417/559 |

* cited by examiner

CROSS
SECTION D-D

CROSS
SECTION F-F

CROSS SECTION G-G

CROSS SECTION I-I

CROSS SECTION c-c

PRECISION, CONSTANT-FLOW RECIPROCATING PUMP

CROSS-REFERENCE TO RELATED APPLICATION

This application is the U.S. national phase of PCT Application No. PCT/EP2019/077495 filed on Oct. 10, 2019, which claims priority to PCT Application No. PCT/IB2018/057954 filed on Oct. 14, 2018 and PCT Application No. PCT/EP2019/062117 filed on May 12, 2019, the disclosures of which are incorporated in their entirety by reference herein.

The invention relates to a volumetric pump consisting of two pistons for the accurate and variable flow-rate dispensing of liquid, of medicine, of food, of detergent, of cosmetic product, of chemical compound or any other type of fluid, gel or gas.

PRIOR ART

There are various pumps with a cam as described in the patent PCT/IB2013/059393 in which the operating principle consists in driving a rotor containing two cylinders and pistons for obtaining an even flow rate.

In the patent PCT/IB2013/059393, the driving of each piston is done by means of an axis guided by one or both of the ends of the axis running through a cam placed in the stator and optionally by an opposing similar cam in the cover. This mechanism is incorporated in the fluidic module or interchangeable pump head, made of plastic to be disposable.

The main problem encountered by this system stems from the fact that the driving elements of the pistons are incorporated in the interchangeable fluidic module, made of inexpensive plastic, affecting the accuracy of the pump given that the stroke of the pistons depends on the quality of the movement imparted to the guiding axes along the cam. The wear of the plastic parts reduces the life of the pump head which, in some cases, even culminates in the breaking of the cam when the heating originating from the friction of the axes along the cam is prolonged. The lateral supports of the cam can also be deformed or even break when the pressure in the pump increases, which limits the use of this type of pump for applications requiring pressures greater than a few bar.

Another disadvantage is that the seal between the rotor and the stator is made using a seal of circular form which undergoes one-way circular friction during the operation of the pump, thus creating a significant localized heating on the rotor which can rapidly be deformed and render the pump inoperative.

DESCRIPTION OF THE INVENTION

The present invention relates to an efficient pump composed of a reduced number of parts with very low production cost for the pumping and dosing of liquids, viscous products or gases with even variable flow rate.

This invention solves the problems explained previously, by controlling the movements of the pistons and of the switching element of the valves, preferably linearly and parallel to one another, by a single rotor positioned in a driving mechanism of the pump outside the interchangeable fluidic module. All the movements of the driving mechanism are produced by robust and accurate standard guiding elements, reliably ensuring a guiding of the pistons and able to withstand very high pressures in the pump. It is thus possible to produce a pump with even variable flow rate that is very accurate, durable and suited to applications requiring pressures greater than a few bar.

The production of the pump head is also more economical because the latter advantageously comprises a reduced number of elements in contact with the fluid, i.e. two cylinder blocks that are preferably identical, two pistons that are preferably identical, one switching element of the valves and preferably seals.

The pumping principle consists in driving a rotor placed in the mechanism of the pump, provided with a guiding cam groove allowing the pistons to be displaced independently axially in the cylinder blocks via carriages. This cam groove is composed of six segments:

- an emptying start segment with flow rate less than the nominal flow rate of the pump
- a long emptying segment with the nominal flow rate of the pump
- an emptying end segment with flow rate less than the nominal flow rate of the pump
- a switching segment of the valves switching between the outlet port then the inlet port on the pumping chamber
- a filling segment
- a switching segment of the valves switching between the inlet port then the outlet port on the pumping chamber During the emptying phase of a chamber at the nominal flow rate of the pump, the other chamber switches from the outlet port to the inlet port, then is filled completely and switches from the inlet port to the outlet port. On the other hand, the two chambers expel simultaneously to the outlet port, each at a reduced flow rate along the two emptying start and end segments, placed in opposition on the cam. The sum of these two reduced flow rates is equivalent to the nominal flow rate of the pump so that the outlet flow rate remains always equivalent to the nominal flow rate, continuous, uninterrupted and even. The rotor also comprises an eccentric axis allowing the switching element of the valves to be displaced, via a valve carriage, synchronously with the pumping strokes of the pistons.

DESCRIPTION OF THE DRAWINGS

The present invention will be better understood on reading the description of the examples given in a purely indicative and nonlimiting manner, with reference to the attached drawings in which.

Figure 1:
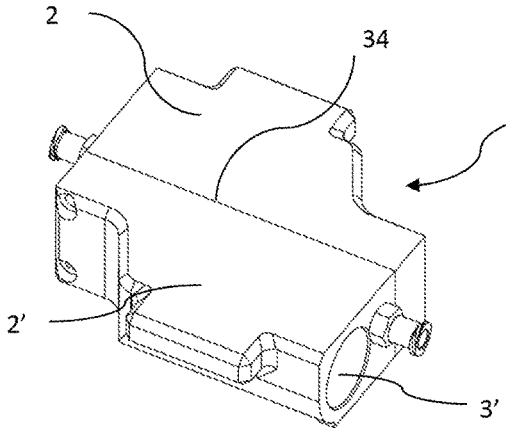
FIG. 1 is a view of the interchangeable fluidic module.
Figure 2:
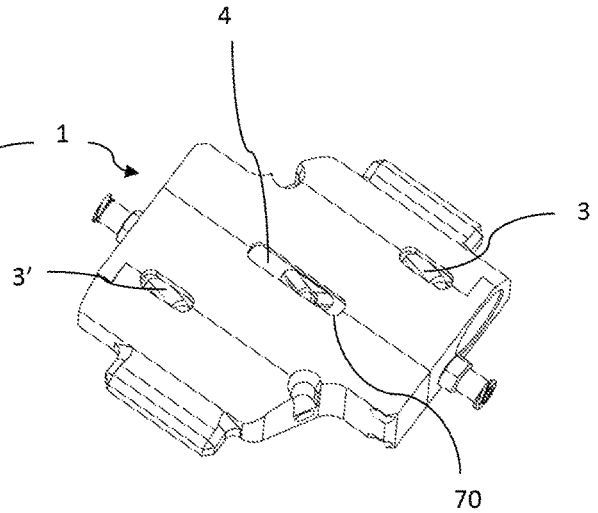
FIG. 2 is a bottom view of the interchangeable fluidic module.

According to FIGS. 1 to 5 and 11 and 13, the interchangeable fluidic module (1) is composed of two cylinder blocks (2,2'), preferably identical, joined in opposition with the joining line (34) parallel to the axes of displacement of the pistons (35,35') and a switching element of the valves (4) positioned between the two cylinder blocks (2,2'). The cylinder blocks (2,2') comprise openings (70',70") on their rear face so as to form an opening (70), when they are joined, allowing access to the switching element of the valves (4) from the outside. Each cylinder block (2,2') respectively comprises an opening (80,80') on its rear face so as to allow access to the pistons (3,3') from the outside. The axis of rotation (97) of the rotor (14) is preferably situated between the axes of displacement of the pistons (35,35') and equidistant from each of them. The axis of rotation (97) of the rotor (14) is preferably at right angles to the axes of displacement of the pistons (35,35') and parallel to the switching axis (7).

Figure 3:
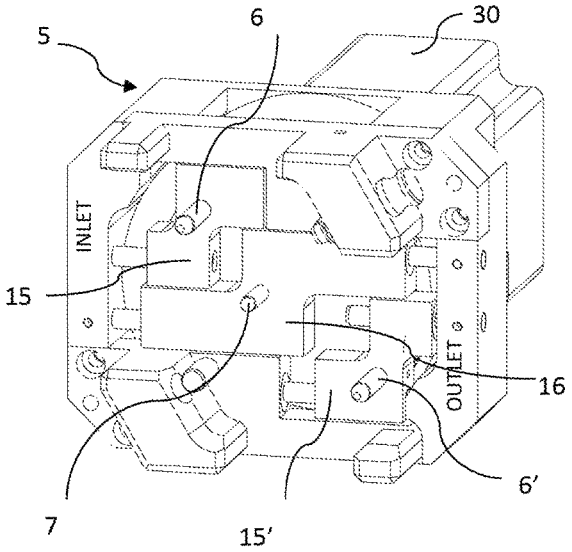
FIG. 3 is an overview of the pumping mechanism.
Figure 4:
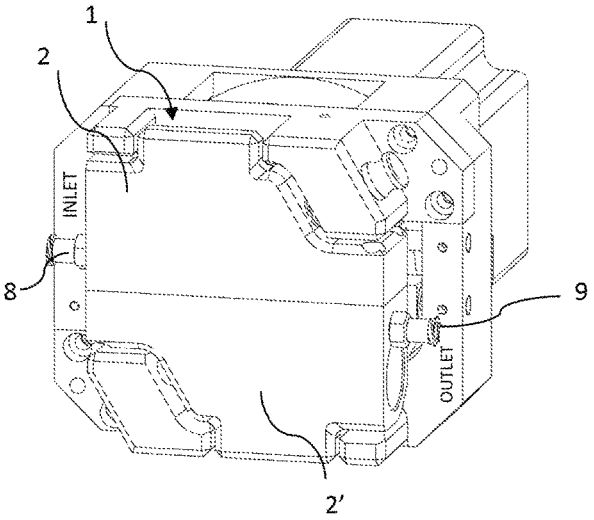
FIG. 4 is an overview of the pumping mechanism with the interchangeable fluidic module inserted.
Figure 12:
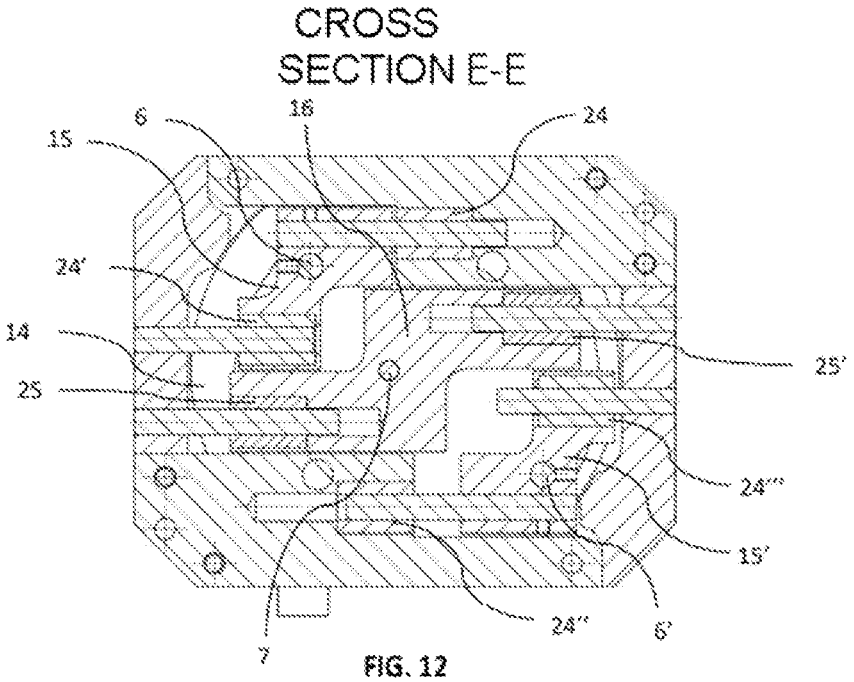
FIG. 12 is a view in cross section along the line E-E of FIG. 8.

FIG. 3 shows the pumping mechanism (5) coupled to a motor (30). The pumping axes (6,6') and the switching axis (7) linearly actuate, respectively, the two pistons (3,3') and the switching element of the valves (4) of the interchangeable fluidic module (1). In FIG. 12, the pumping axes (6,6') are fixed to pumping carriages (15,15') guided by linear rolling bearings (24, 24', 24", 24'"). Each carriage (15,15') is actuated simultaneously but independently of one another during the angular displacement of the rotor (14). The switching axis (7) of the valves is fixed onto the carriage of the valves (16) also guided by linear rolling bearings (25, 25'). FIG. 4 shows the pumping mechanism with the interchangeable fluidic module (1) inserted. The inlet port (8) is preferably situated on the cylinder block (2), and the outlet port (9) is preferably situated on the cylinder block (2').

According to FIGS. 5, 6, 11 and 13, the two pistons (3,3') receive sealing elements, preferably O-rings (10, 10', 10", 10'") and are inserted into the opposing pumping chambers (11,11'), that are preferably cylindrical, of the cylinder blocks (2,2') that are parallel and eccentric with respect to the axis of rotation (97) of the rotor (14). The port (13) of the pumping chamber (11) is connected with the opening (71), and the port (13') of the pumping chamber (11') is connected with the opening (71'). The inlet port (8) is connected with the inlet port of the valves (8') and the outlet port (9) is connected with the outlet port of the valves (9'). The inlet port (8) and the outlet port (9) are placed between the pumping chambers (11,11').

Figure 5:
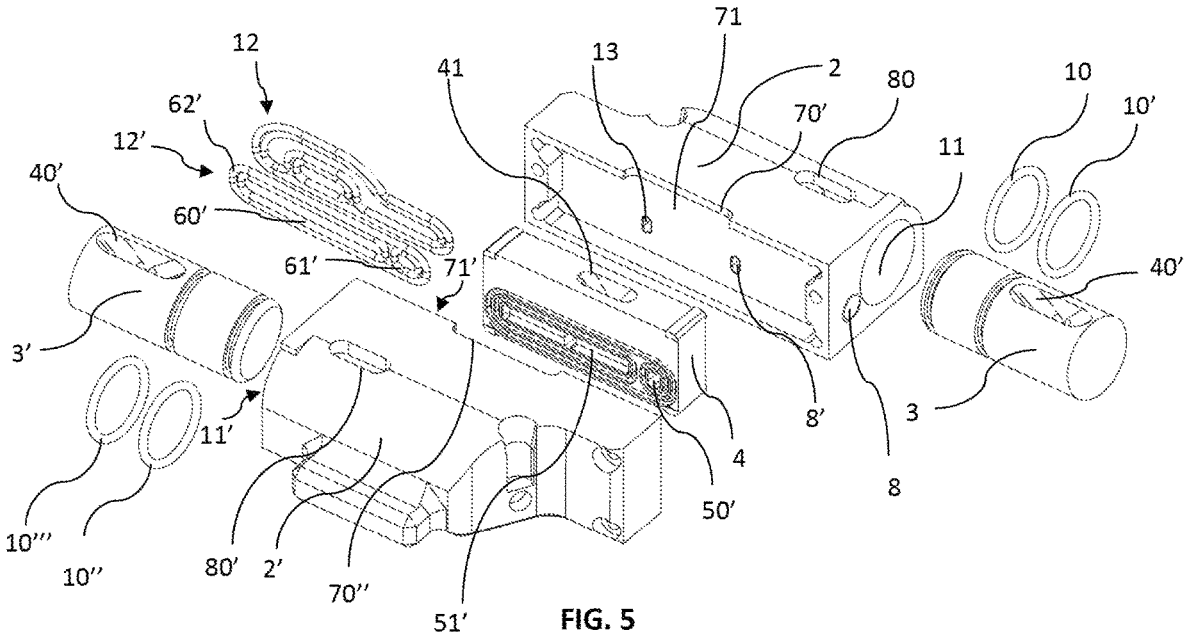
FIG. 5 is an exploded view of the interchangeable fluidic module.
Figure 6:
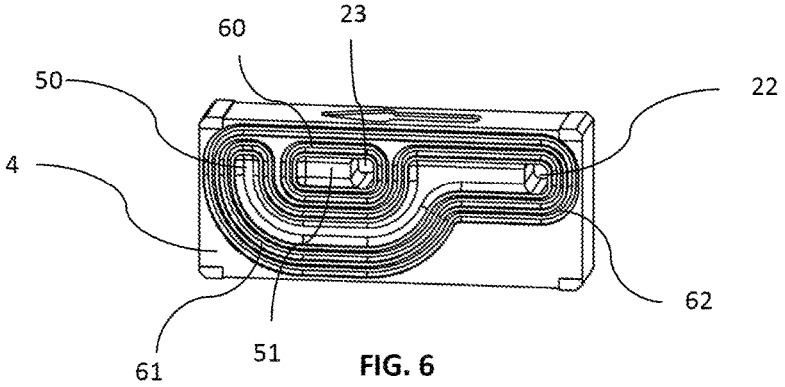
FIG. 6 is a view of the switching element of the valves.
Figure 7:
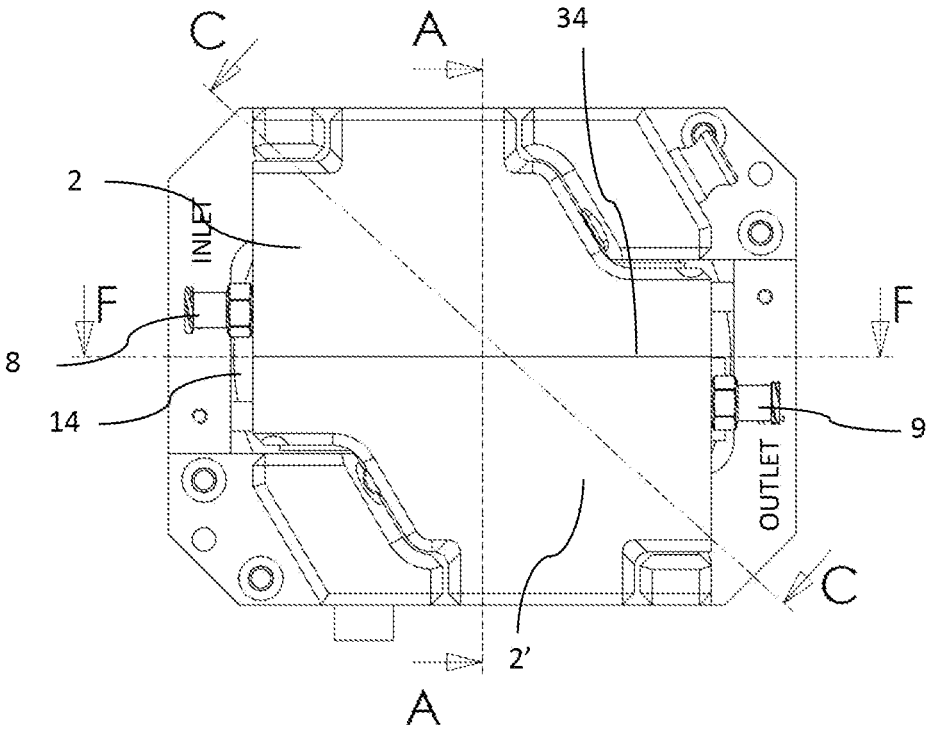
FIG. 7 is a front view of the invention.
Figure 8:
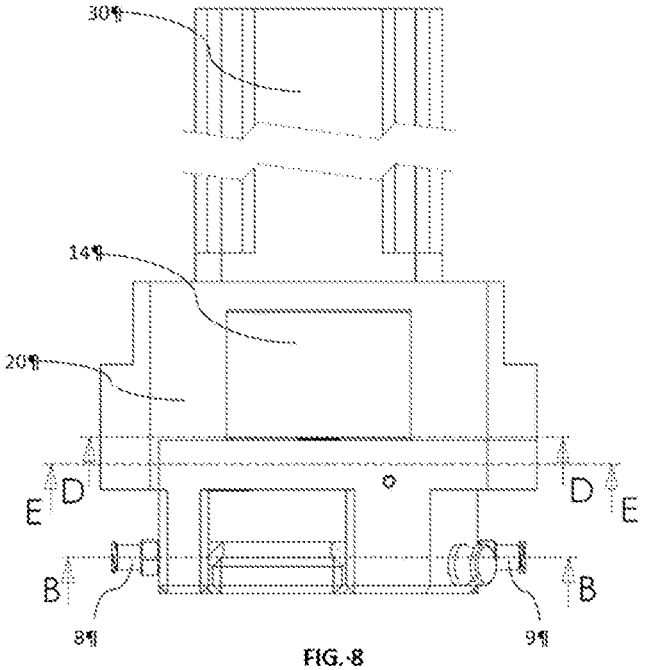
FIG. 8 is a top view of the invention.

The valve seals (12,12') are inserted on each side of the switching element of the valves (4). Each form seal (12,12') preferably comprises three contours, respectively (60, 61, 62) and (60', 61', 62') of which the latter can be linked together during the molding of the form seals (12,12') into single seals. It is also possible to produce the form seals (12,12') by the use of O-ring seals that are not linked to one another. The form seal (12) does not have the same geometry as the seal (12') in order to allow, on the one hand, the simultaneous opening of the ports (13,13') of the pumping chambers (11,11') to the outlet port (9) and the alternate opening of the ports (13,13') of the pumping chambers (11,11') to the inlet port (8). The contours (60, 60') and (61, 61') respectively surround the inlet (50, 50') and outlet (51,51') of the transfer chambers. The form seals (62, 62') ensure the seal-tightness with the outside. FIGS. 5 and 6 illustrate, among other things, the switching element of the valves (4) which preferably has the geometry of a rectangular block.

The port (22) allows the link between the inlet transfer chambers (50,50'), and the port 23 allows the link between the outlet transfer chambers (51,51'). The inlet transfer chambers (50,50') are thus always linked with the inlet port (8). The outlet transfer chambers (51,51') are thus always linked with the outlet port (9).

The rotor (14) displaces, by reciprocating movement, the switching element of the valves and thus links the port (13) to the pumping chamber (11) with the inlet transfer chamber (50) for the filling, or with the outlet transfer chamber (51) for the emptying, and the port (13') of the pumping chamber (11') with the inlet transfer chamber (50') for the filling, or with the outlet transfer chamber (51') for the emptying. These links are synchronized with the movement of the pistons.

The inlet transfer chamber (50) is preferably disposed so as to be on either side of the outlet transfer chamber (51).

Figure 9:
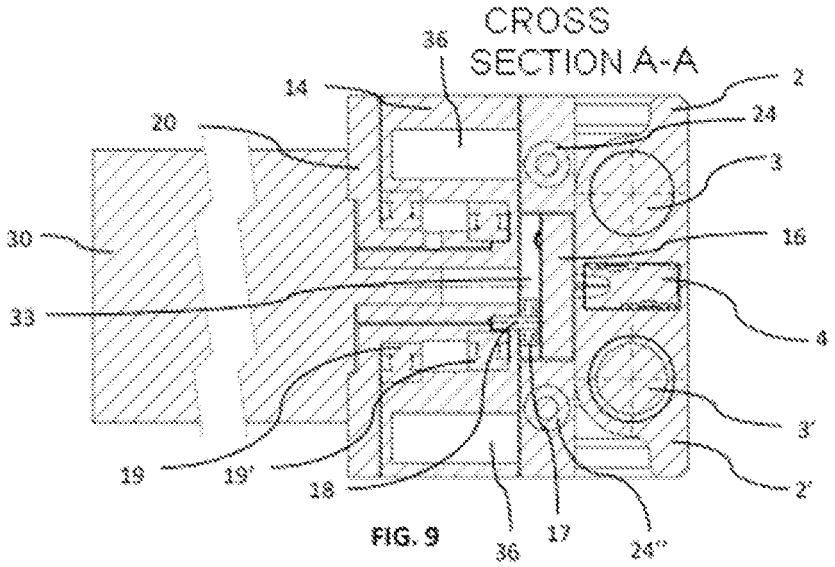
FIG. 9 is a view in cross section along the line A-A of FIG. 7.

According to FIGS. 3, 9 and 12, the rotor (14) is coupled on the axis of the motor (30) and held by ball bearings (19,19') on the base (20) of the pumping mechanism (5). A guiding element (17), preferably a ball bearing, placed on the driving axis of the valves (18) mounted eccentrically on the rotor (14), and housed in a groove (33), exerts a reciprocating linear driving of the carriage of the valves (16) guided by linear bearings (25,25').

Figure 10:
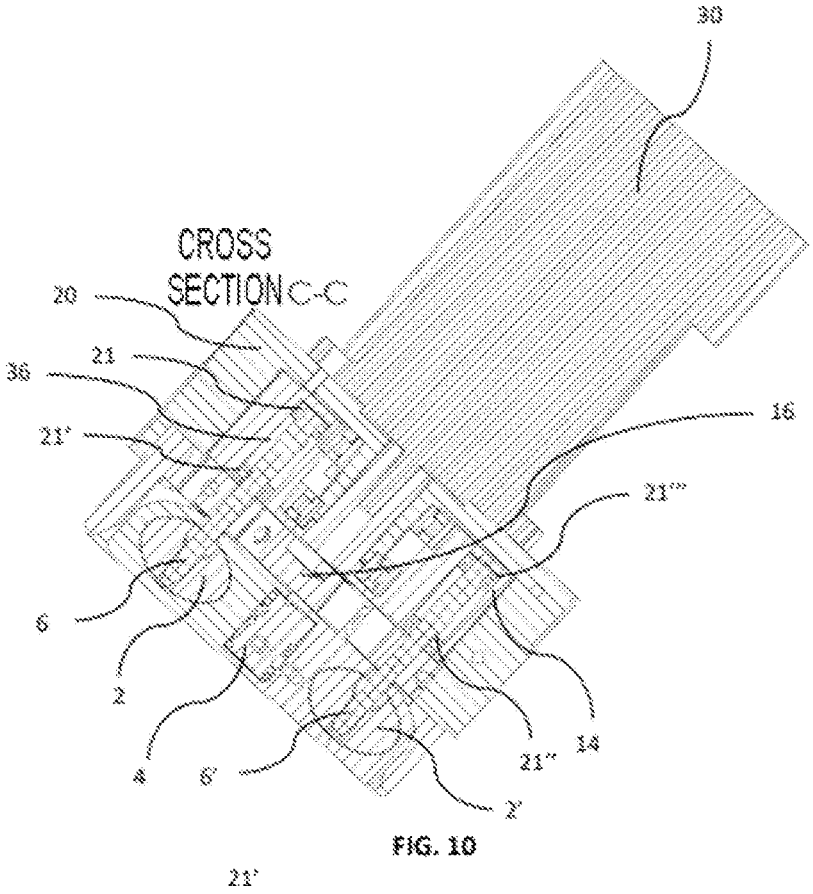
FIG. 10 is a view in cross section along the line C-C of FIG. 7.

According to FIGS. 9, 10 and 12, a cam groove (36) placed axially in the rotor (14) makes it possible to displace the pumping axes by the rolling of guiding elements (21, 21', 21", 21'"), preferably ball bearings, inside the cam groove (36), and thus exert a reciprocating linear movement on the pumping carriages (15,15') guided by linear guidances (24, 24', 24", 24'"). The movement of the carriage of the valves (16) is conducted with the linear guiding elements (25,25').

Figure 11:
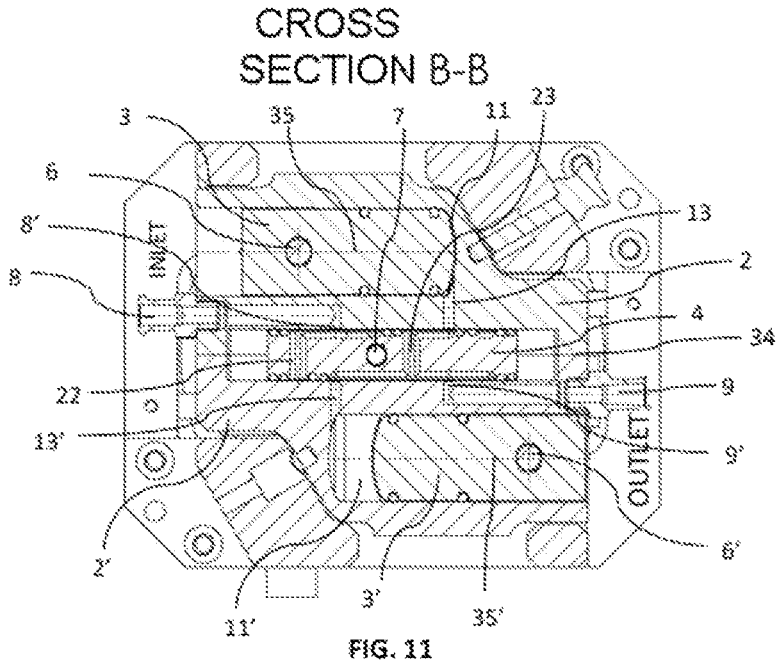
FIG. 11 is a view in cross section along the line B-B of FIG. 8.

FIG. 11 shows the coupling of the pumping axes (6,6') in the pistons (3,3') and the switching axis (7) in the switching element of the valves (4). This cross-sectional view also makes it possible to illustrate the ports around the switching element of the valves (4), i.e. the link between the pumping chambers (11,11') with the ports (13,13') and the inlet port (8) with the valve inlet port (8'), and the outlet port (9) with the valve outlet port (9').

Figure 13:
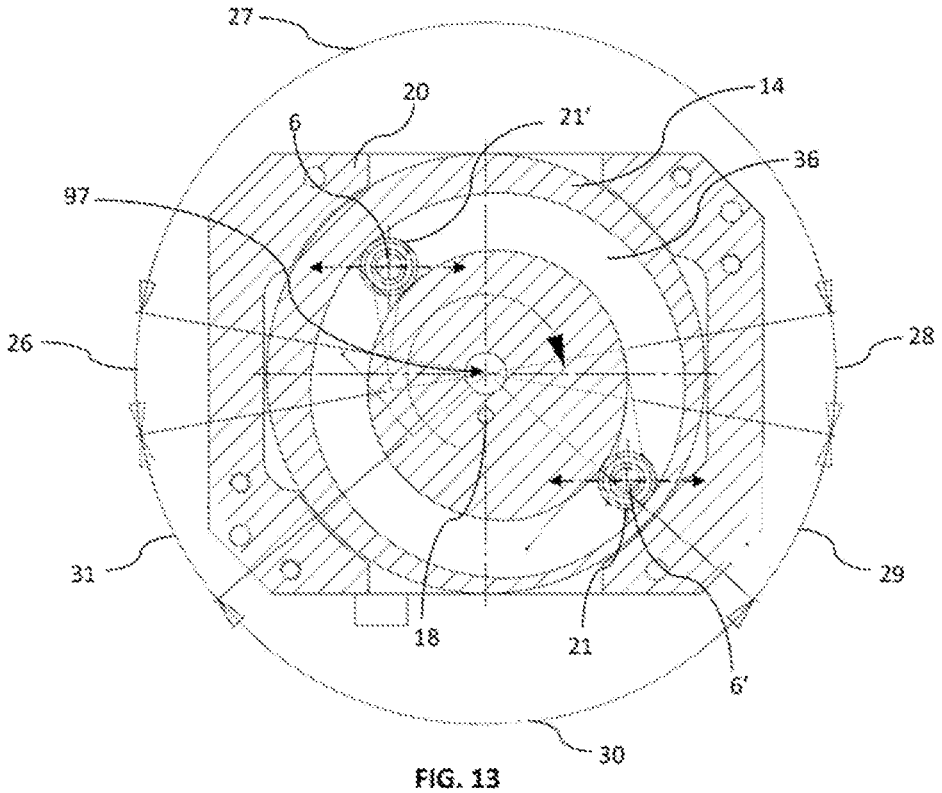
FIG. 13 is a view in cross section along the line D-D of FIG. 8.

FIG. 13 shows the profile of the cam grove (36) in the rotor (14). The two pistons (3,3') perform their respective and independent linear displacement in opposition, i.e. at 180° from one another, via the pumping axes (6,6'), along the profile of the cam groove (36). This profile is broken down into 6 segments (26, 27, 28, 29, 30, 31) intended for a clockwise rotation of the rotor (14). The cam groove (36) can also be profiled for a rotation of the rotor (14) in the counterclockwise direction. The segment (26) corresponds to the initial emptying phase with reduced displacement of a piston, corresponding preferably to half the nominal flow rate. The segment (27) corresponds to the emptying phase with nominal displacement of a piston, corresponding to the nominal flow rate. The segment (28) corresponds to the final emptying phase with reduced displacement of a piston, corresponding preferably to half the nominal flow rate. The segment (29) corresponds to the switching phase of the valves which closes the link between the port of a pumping chamber and the respective outlet transfer chamber then links the inlet transfer chamber with the port of the pumping chamber, and without movement of the piston. The segment (30) corresponds to the phase of filling of a pumping chamber. The segment (31) corresponds to the phase of switching of the valves which forms the link between the port of a pumping chamber and the respective inlet transfer chamber then links the outlet transfer chamber with the port of the pumping chamber, and without movement of the piston. The segments (26, 27, 28) for the emptying of the chambers are dimensioned so as to produce a linear displacement of the pistons (3,3') that is proportional to the angle of rotation of the rotor (14). The segments (26) and (28) placed in opposition, make it possible to obtain a continuous linear flow rate, because the piston beginning its emptying phase on the segment (26) delivers simultaneously with the piston ending its emptying phase on the segment (28).

Figure 14:
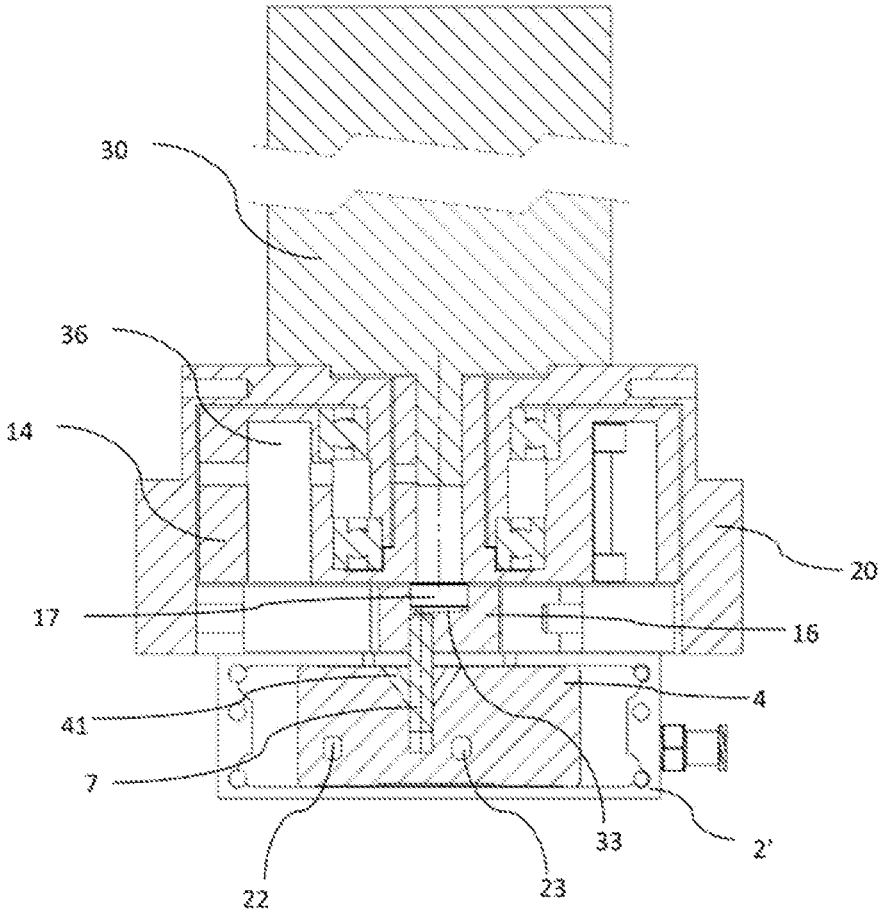
FIG. 14 is a view in cross section along the line F-F of FIG. 7.

According to FIG. 14, the ball bearing (17), housed in the groove (33) of the carriage of the valves (16), allows the reciprocating linear displacement thereof in order to produce the switching of the valves by driving the switching element of the valves (4) placed between the cylinder blocks (2, 2') and linked to the carriage of the valves (16) via the switching axis (7).

Figure 15:
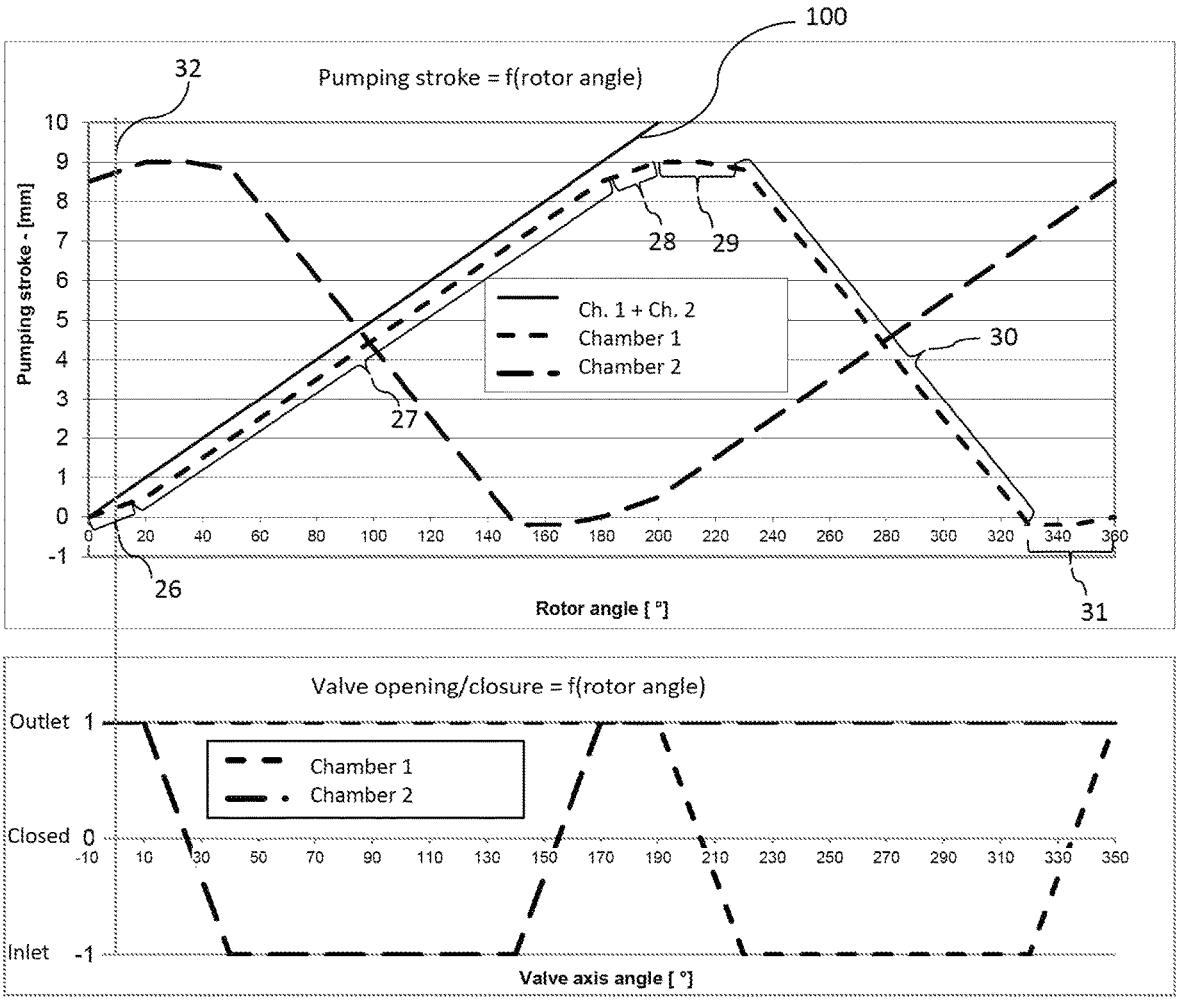
FIG. 15 is a graph showing the linear displacements of the pistons according to the angular displacement of the rotor superposed with a second graph representing the state of the valves as a function of the angle of the axis of the valves.
Figure 16:
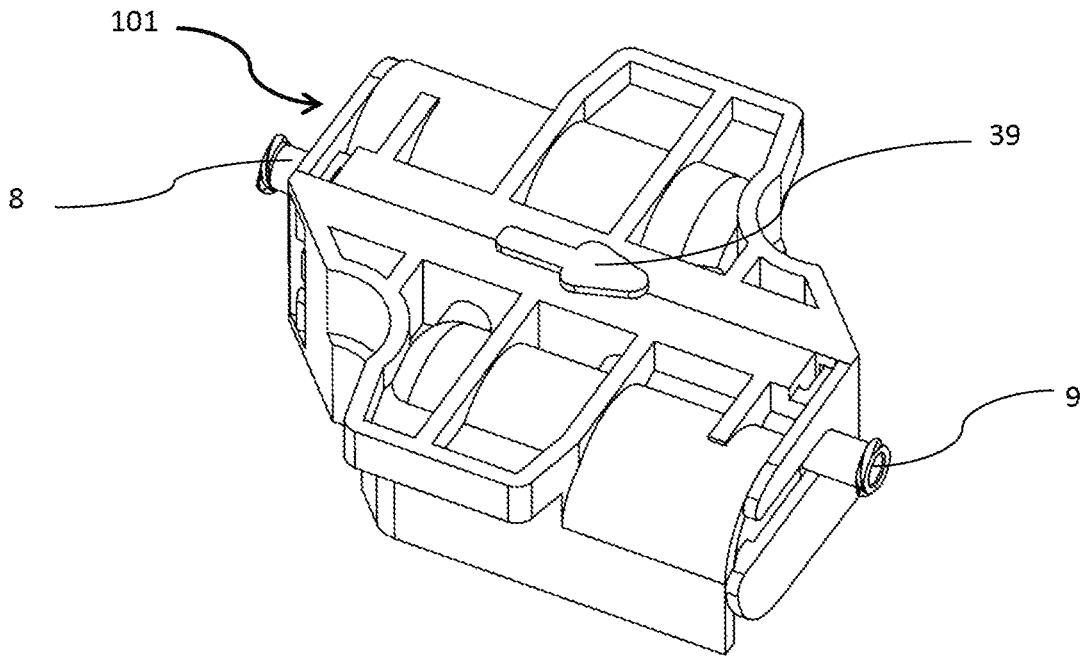
FIG. 16 is a view of the interchangeable fluidic module produced by plastic injection molding.
Figure 17:
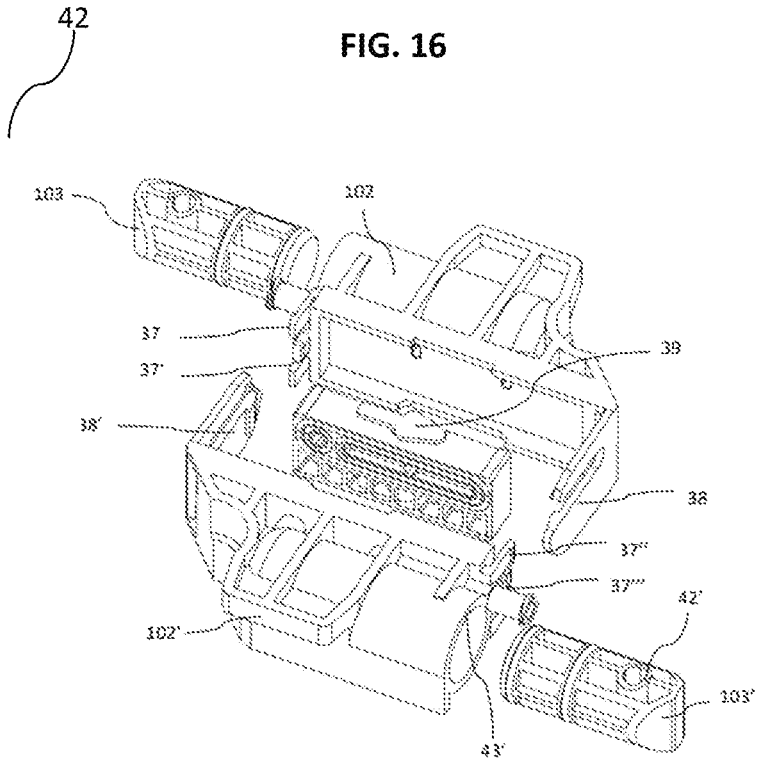
FIG. 17 is an exploded view of the interchangeable fluidic module produced by plastic injection molding.
Figure 18:
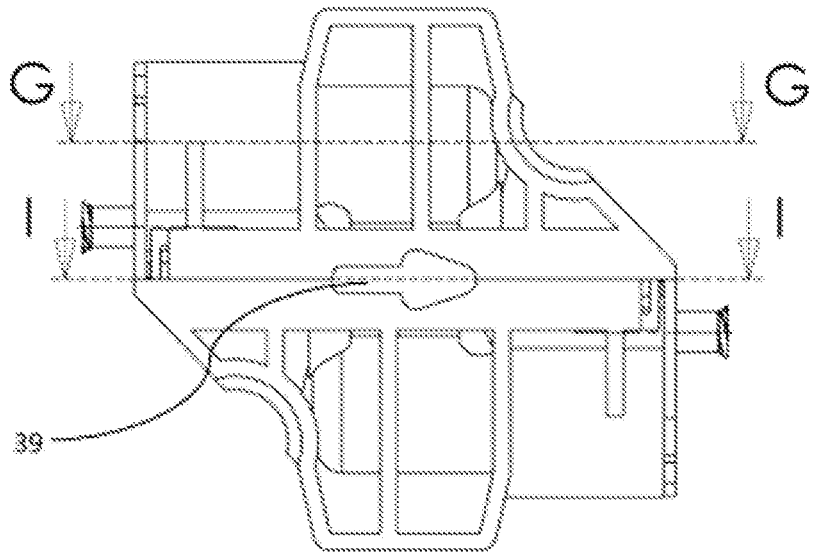
FIG. 18 is a front view of the interchangeable fluidic module.

FIG. 15 shows two superposed graphs illustrating the synchronization of the different operating sequences of the pump according to the displacement of the two pistons along the segments of the cam (top graph) and the angular displacement of the driving axis of the valves (18) producing the movement of the switching elements of the valves (4) and the states of the valves (bottom graph). The vertical line (32) corresponds to the angular position of the pump in FIG. 12. The "chamber 1" curve relates to the pumping axis (6) corresponding to the pumping chamber (11) and the "chamber 2" curves relates to the pumping axis (6') corresponding to the pumping chamber (11'). The pumping segments (26, 27, 28, 29, 30, 31) of the cam groove (36) represented in FIG. 12 are indicated by braces on the chamber 1 curve, which are also valid for chamber 2.

The curve (100) corresponds to the cumulative displacement of the two pistons, over the portions during which the outlet valves are open for each of the chambers, as a function of the angular displacement of the rotor. It can be seen that this curve (100) is an uninterrupted continuous straight line corresponding to an outlet flow rate of the pump that is continuous, uninterrupted and even.

In the bottom graph, the switching of the valves is indicated as a function of the pumping segments of chambers 1 and 2.

According to the above descriptions, the controlled displacements of the pistons (3,3') and of the switching element of the valves (4) are done preferably alternately and parallel to one another while being synchronized with the angular displacement of the rotor (14).

The cam groove (36) can be dimensioned to produce any form of outlet and inlet flow rate signal.

FIGS. 16 to 20 show the version of the interchangeable fluidic module (101) with parts produced by plastic injection molding. The fixing between the cylinder blocks is ensured by clips (37, 37', 37", 37'"). Access to the pistons and pumping chambers is protected by the protective elements (38,38') making it possible to cover the pumping chamber of a cylinder block by the other cylinder block and vice versa. An arrow (39) fixed onto the switching element of the valves identifies the inlet (8) and the outlet (9) of the pump. The insertion and the orientation of the pistons (103,103') in the pumping chambers (11,11') is ensured by the angular positioning lugs (42,42') housed respectively in the grooves (43,43') situated on the cylinder blocks (102,102').

Figure 19:
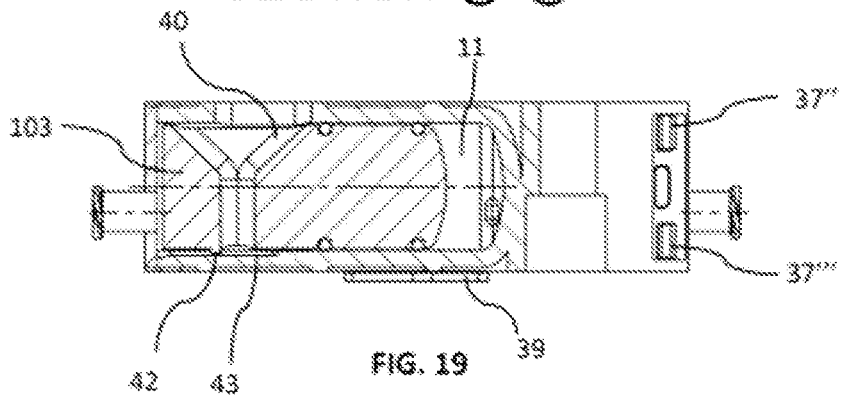
FIG. 19 is a view in cross section along the line G-G of FIG. 18.

FIG. 19 illustrates the inlet chamfers (40, 40') on the pistons (103,103') to allow insertion of the pumping axes (6,6') regardless of the position of the pistons (103,103').

Figure 20:
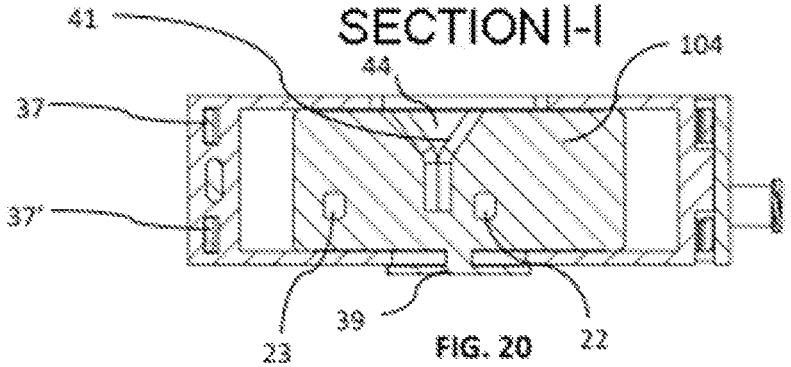
FIG. 20 is a view in cross section along the line I-I of FIG. 18.
Figure 21:
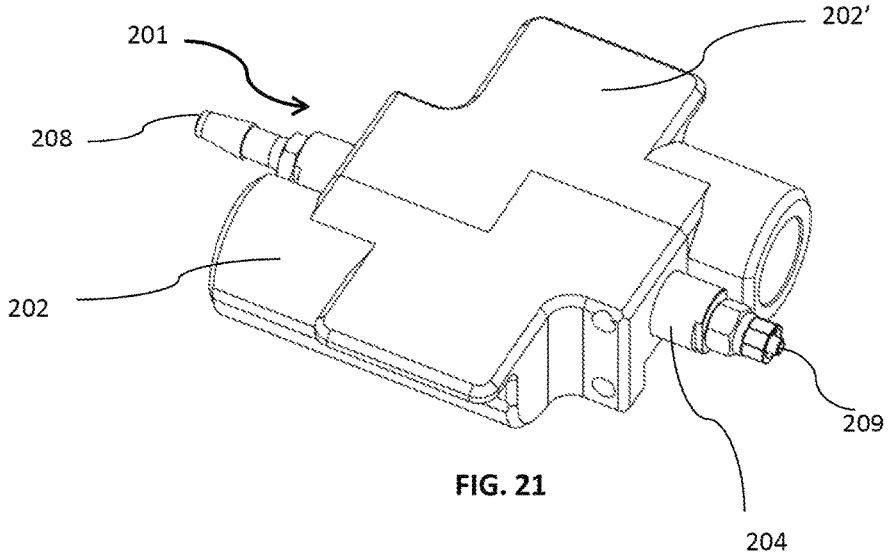
FIG. 21 is a view of a variant of the interchangeable fluidic module with the switching element of the valves which is cylindrical.
Figure 22:
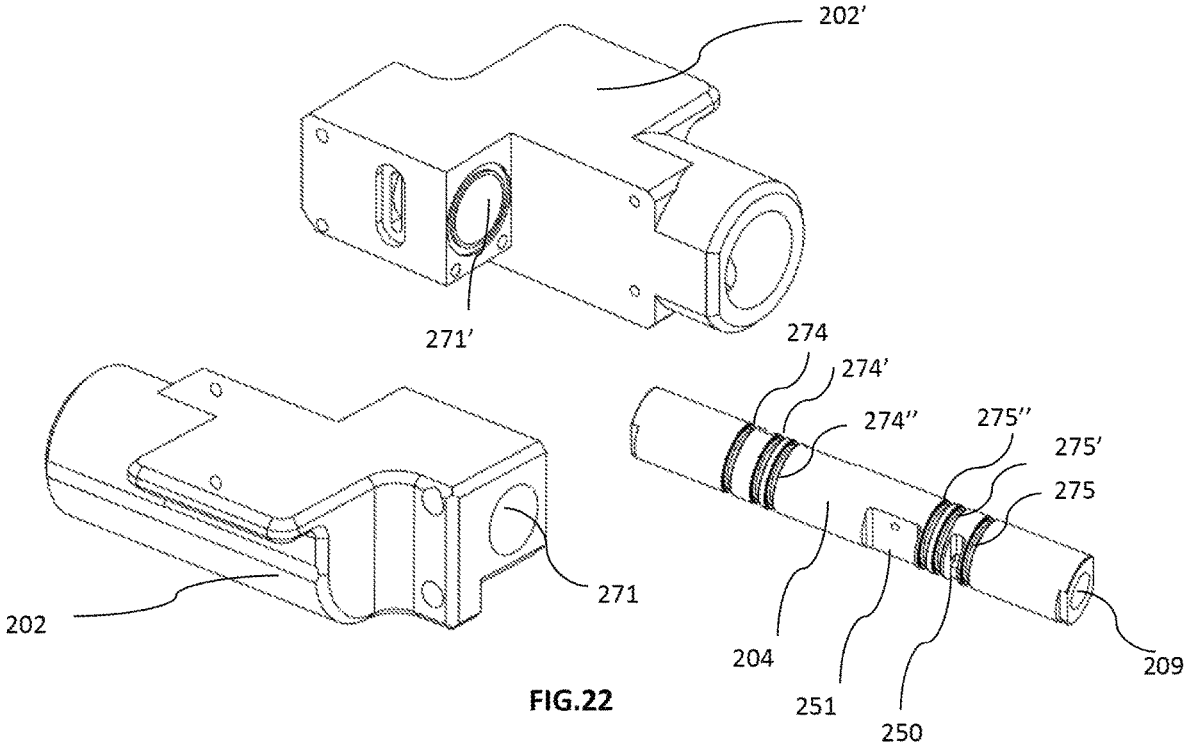
FIG. 22 is an exploded view of the variant of the interchangeable fluidic module with the switching element of the valves which is cylindrical.
Figure 23:
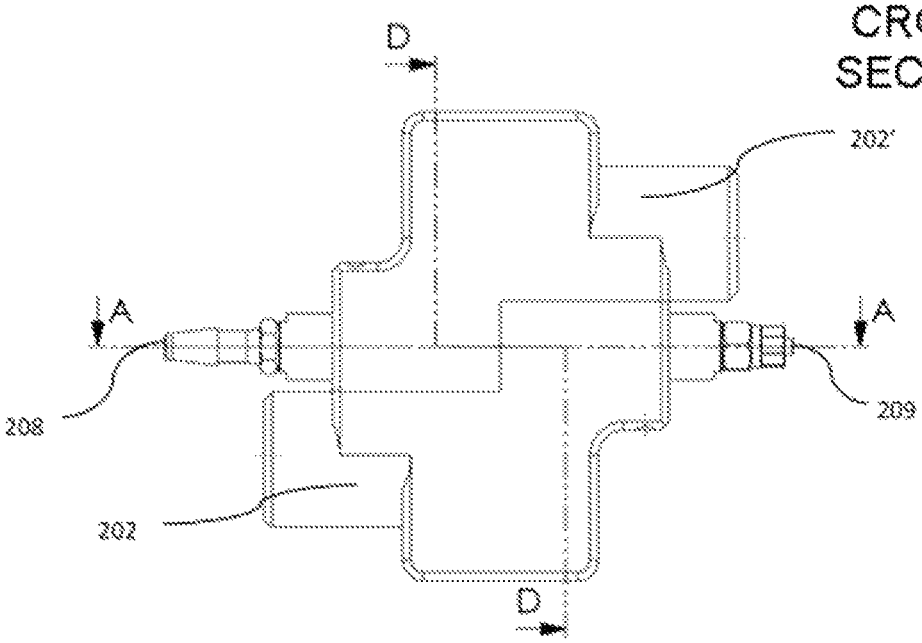
FIG. 23 is a front view of the variant of the interchangeable fluidic module with the switching element of the valves which is cylindrical.
Figure 24:
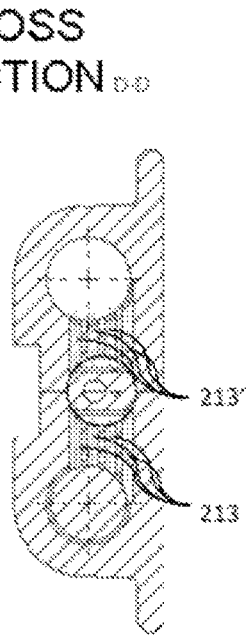
FIG. 24 is a view in cross section along the line D-D of FIG. 23.
Figure 25:
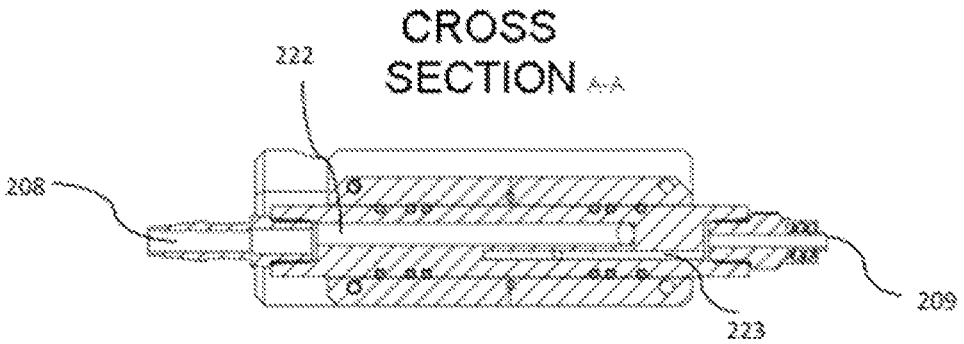
FIG. 25 is a view in cross section along the line A-A of FIG. 23.
Figure 26:
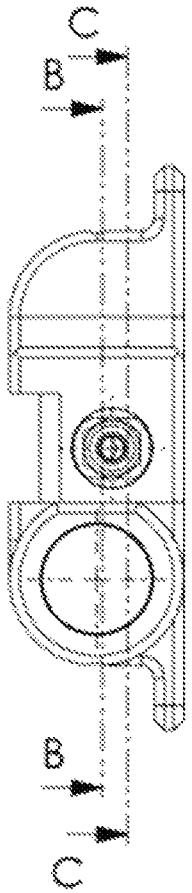
FIG. 26 is a side view of the variant of the interchangeable fluidic module with the switching element of the valves which is cylindrical.
Figure 27:
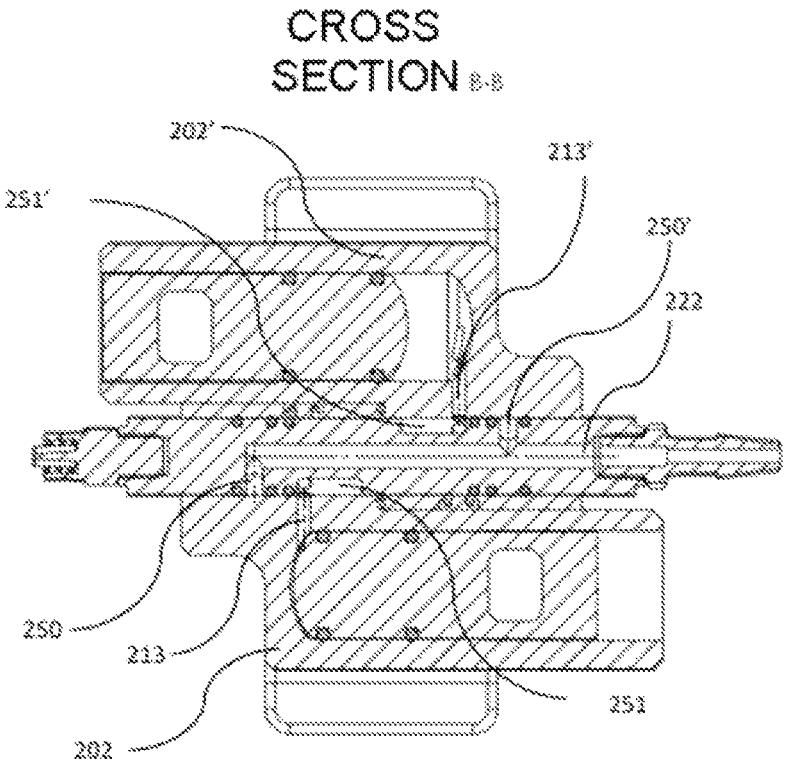
FIG. 27 is a view in cross section along the line B-B of FIG. 26.
Figure 28:
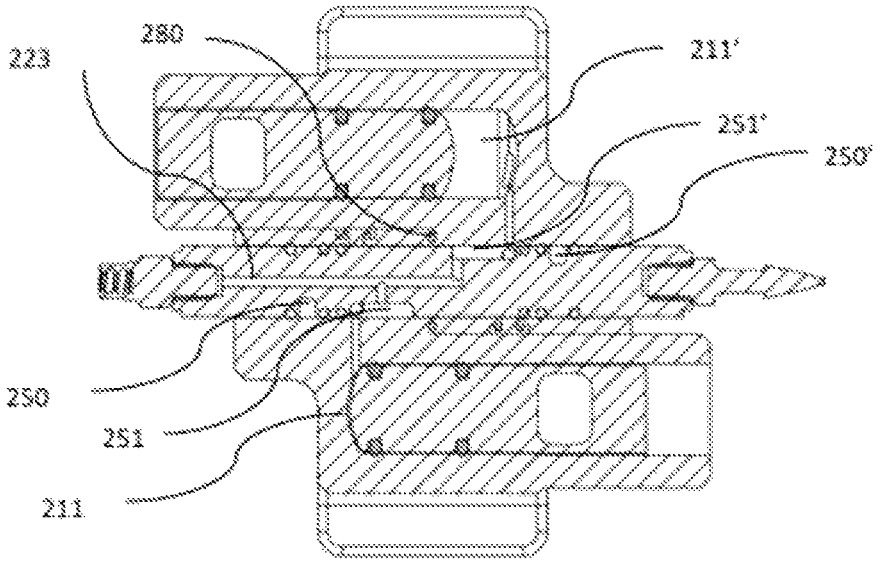
FIG. 28 is a view in cross section along the line C-C of FIG. 26.

FIG. 20 illustrates the inlet chamfers (41) around the opening (44) on the switching element of the valves (104) allowing the insertion of the switching axis (7) regardless of its position.

The inlet (8) and outlet (9) ports can be placed on the front or the sides of the cylinder blocks (2, 2', 102, 102'). In a variant that is not illustrated, the valve seals (12,12') can be housed in the cylinder blocks (2, 2', 102, 102'), in contact with the switching element of the valves (4, 104).

In the variant illustrated in FIGS. 21 to 30, the interchangeable fluidic module (201) has a switching element of the valves (204) of preferably cylindrical section. This switching element of the valves (204) slides in a housing formed by two openings (271, 271') that are preferably contiguous in the cylinder blocks (202, 202') parallel to the pumping chambers (211, 211'). The switching element of the valves (204) is driven preferably at its ends, preferably by two opposing elements (not illustrated) fixed onto the carriage of the valves (16).

The switching of the valves is performed by the alignment of the port (213) of the pumping chamber with the inlet (250) or outlet (251) transfer chambers, and of the port (213') of the pumping chamber with the inlet (250') or outlet (251') transfer chambers. The port (213) of the pumping chamber (211) is connected with the opening (271), and the port (213') of the pumping chamber (211') is connected with the opening (271').

The peripheral sealing of the inlet (250, 250') and outlet (251, 251') transfer chambers is preferably ensured by O-rings (274, 274', 274") and (275, 275', 275"). A seal (280) situated between and around the openings (271,271') ensures the internal sealing between the cylinder blocks (202,202').

The inlet connection port (222) of the switching element of the valves (204) is connected with the inlet transfer chambers (250, 250') and the inlet port (208) of the pump. The outlet connection port (223) of the switching element of the valves (204) is connected with the outlet transfer chambers (251, 251') and the outlet port (209) of the pump.

The inlet port (208) and the outlet port (209) are placed between the pumping chambers (211,211').

Figure 29:
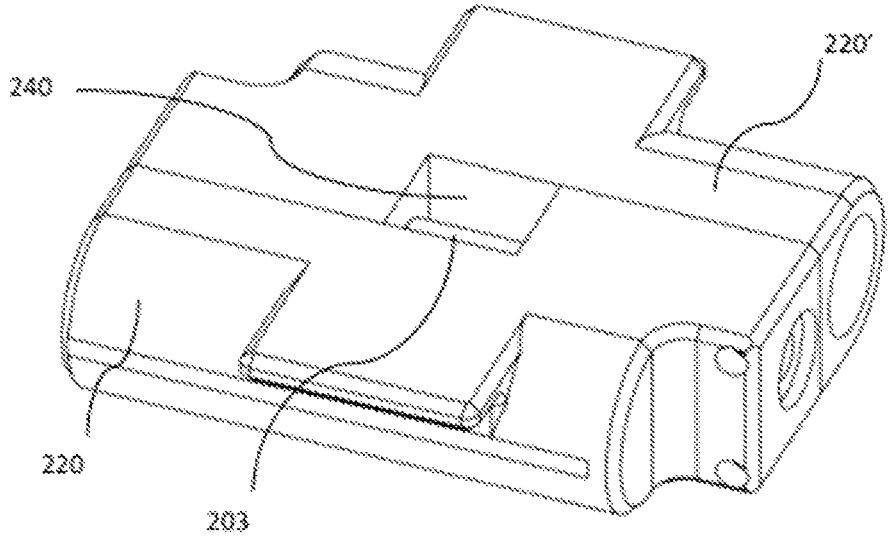
FIG. 29 is a view of the variant of the interchangeable fluidic module with the switching element of the valves which is cylindrical and driven by the center.

FIG. 29 represents a variant of the interchangeable fluidic module (201) having a switching element of the valves (204) of cylindrical section which is driven by the middle. An opening (240) situated between the cylinder blocks (220, 220') allows access to the switching element of the valves (204) by the driving element (not illustrated).

Figure 30:
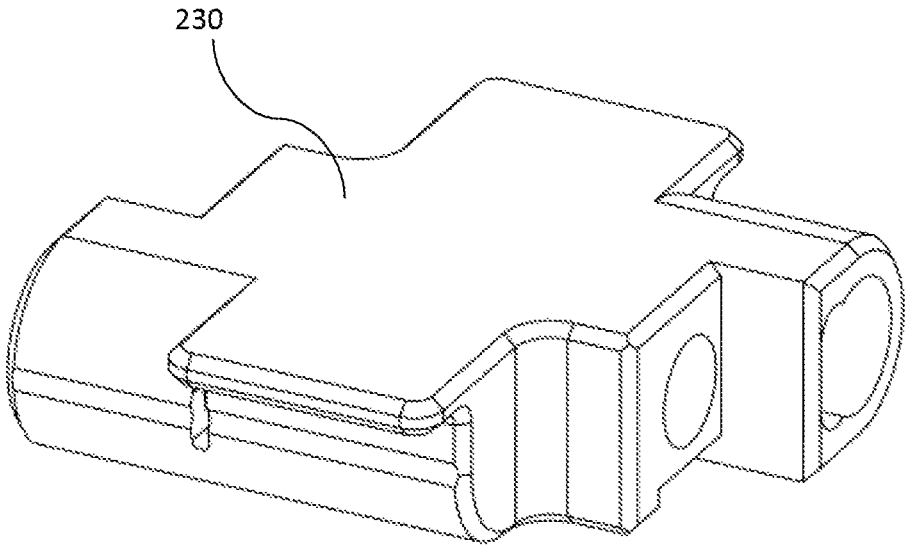
FIG. 30 is a view of a variant of the single-piece double cylinder block of the variant of the interchangeable fluidic module with the switching element of the valves which is cylindrical and driven by the center.
Figure 31:
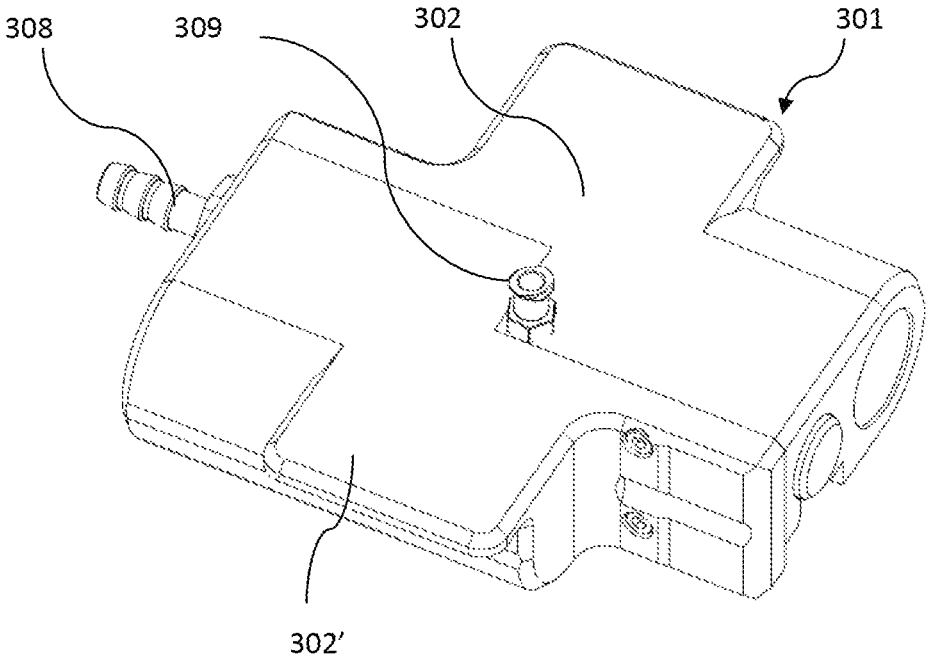
FIG. 31 is a view of a variant of the interchangeable fluidic module with the switching element of the valves which is cylindrical and driven by one side and in which the inlet and outlet ports are fixed to the cylinder blocks.
Figure 32:
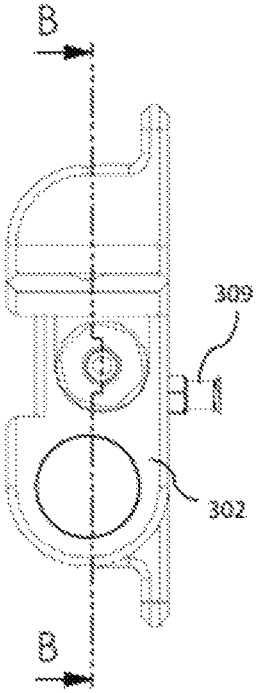
FIG. 32 is a profile view of FIG. 31.
Figure 33:
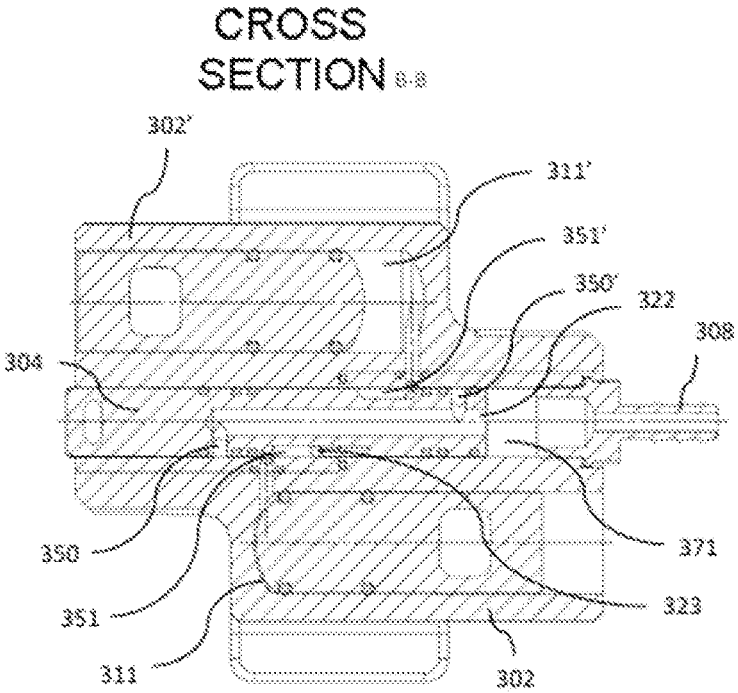
FIG. 33 is a view in cross section along the line B-B of FIG. 32.
Figure 34:
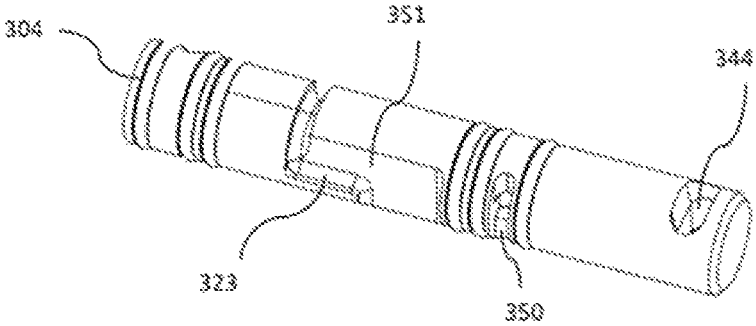
FIG. 34 is a perspective view of the cylindrical switching element of the valves of the variant of the interchangeable fluidic module of FIG. 31.

FIG. 30 represents a variant of the interchangeable fluidic module (201) having a switching element of the valves (204) of cylindrical section or the cylinder blocks are produced in a single piece (230).

According to FIGS. 31 to 34, the inlet (308) and outlet (309) ports are placed on the cylinder blocks (302,302'). The inlet port (308) is preferably of wide section in order to be able to suck viscous fluids at a high flow rate and is fixed at the end of the opening (371) of the cylinder block (302'). The outlet port (309) is fixed preferably onto a face of the cylinder block (302) and at right angles to the movement of the valve element (304).

The inlet connection port (322) of the switching element of the valves (304) is connected with the inlet transfer chambers (350, 350') and the inlet port (308) of the pump. The outlet connection port (323) of the switching element of the valves (304) is connected with the outlet transfer chambers (351, 351') and the outlet port (309) of the pump.

The switching element of the valves (304) comprises, preferably on one of its sides, an opening (344) receiving the switching axis (7).

In a variant that is not illustrated, ducts, preferably linked with the inlet and outlet ports, can be placed in the cylinder blocks and adapted so as to link pressure measurement elements such as, for example, membranes or any other component reacting to pressure variation.

In a variant that is not illustrated, the valve element can be wholly or partly rounded so as to pivot or rotate during the movement of the pistons by means of the rotor (14).

The cylinder blocks can be joined preferably by clips, screws, conical forms, by welding or by refusion.

The sealing between the moving and fixed parts is preferably produced using elastomers, O-rings, form seals, overmolded seals or any other sealing elements. However, it is possible to produce the pump without sealing seals, preferably by fitting between the parts.

The elements that make up the interchangeable fluidic module (1, 101, 201, 301) are preferably produced in disposable plastic, preferably by injection molding or by machining. The pump can be sterilized for the dispensing of food, medicine or bodily fluids, for example. The choice of the materials is however not limited to plastics.

In a variant that is not illustrated, the switching element of the valves can be in the form of a rotary disk, preferably rotating axially and engaged directly with the rotor.

The invention can be incorporated in units intended for the pumping of chemical, pharmaceutical or petroleum product or any other kind of fluid. It can also be incorporated in medical devices intended to inject or suck fluids into/from the body. These devices can combine several pumps in parallel or in series with external elements such as valves, connectors or any other component that makes it possible to produce multiple fluidic circuits. The invention lends itself particularly well to a use requiring the diffusion or the mixing of fluids under pressure and at high pressure, accurately. It can also be used in systems requiring a dynamic control of the flow rate manually or automatically, such as medical pumps/injectors and dosing/filling systems.

The pump can also be used as an air compressor and be produced in durable materials such as, for example, steel and ceramic for devices requiring intensive use with a long life.

Although the invention is described according to one embodiment, there are other variants which are not presented. The scope of the invention is not therefore limited to this embodiment described previously.

The invention claimed is:

1. A pump with an interchangeable fluidic module comprising:

two pistons, each piston having an axis of displacement;

the two pistons are actuated by two pumping carriages and placed in two opposing pumping chambers;

the two opposing pumping chambers are situated respectively in two cylinder blocks which are held together parallel to the axes of displacement of the pistons;

one of the two cylinder blocks has an inlet port through which fluid is sucked into the pumping chambers during a filling movement of the pistons, then the fluid is expelled from the pumping chambers during an emptying movement of the pistons towards an outlet port in the other of the two cylinder blocks;

a switching element comprising an inlet connection port, inlet transfer chambers, an outlet connection port, and outlet transfer chambers;

the inlet transfer chambers are connected to the inlet by the inlet connection port and the outlet transfer chambers are connected to the outlet by the outlet connection port, the pump comprising a rotor and a motor, wherein the rotor is rotated by the motor;

the movement of the pistons being characterized by a cam groove, the cam grove being placed in the rotor with a rotation axis of the rotor being positioned perpendicular to the axes of displacement of each of the pistons;

wherein the rotor simultaneously actuates movement of the two pumping carriages and the switching element in an independent manner; and wherein the two pumping chambers expel simultaneously to the outlet port over a segment of the cam groove in the rotor.

2. The pump according to claim 1, the switching element is moved by a valve carriage, the valve carriage being driven by the rotor in a reciprocating movement.

3. The pump according to claim 1, wherein the inlet port and the outlet port are located between the pumping chambers.

4. The pump according to claim 1, wherein an output flow rate of the pump is continuous without pulsation.

5. The pump according to claim 1, wherein a profile of the cam groove is composed of six segments.

6. The pump according to claim 1, wherein the interchangeable fluidic module is made of plastic or disposable material.

7. The pump according to claim 1, further comprising seals located between mobile and fixed parts of the interchangeable fluidic module.

8. The pump according to claim 1, wherein the inlet port is formed in the one of the two cylinder blocks and/or the outlet port is formed in the other of the two cylinder blocks.

9. The pump according to claim 8, wherein each one of the two cylinder blocks is made in one piece.

10. The pump according to claim 8, wherein at least one of the two cylinder blocks comprises an opening allowing access to the switching element.

11. The pump according to claim 8, wherein the switching element is placed between the cylinder blocks parallel to the pistons.

12. The pump according to claim 1, wherein the rotor which drives the pistons and the switching element is located external to the interchangeable fluidic module.

13. The pump according to claim 1, wherein the switching element is cylindrical and sealing is ensured by O-ring seals.

14. The pump according to claim 1, wherein the inlet port and/or the outlet port are placed on the switching element.

* * * * *